US006700493B1

(12) United States Patent
Robinson

(10) Patent No.: US 6,700,493 B1
(45) Date of Patent: Mar. 2, 2004

(54) METHOD, APPARATUS AND SYSTEM FOR TRACKING, LOCATING AND MONITORING AN OBJECT OR INDIVIDUAL

(76) Inventor: William A. Robinson, 610 Butler Ave., Point Pleasant, NJ (US) 08742

( * ) Notice: Subject to any disclaimer, the term of this patent is extended or adjusted under 35 U.S.C. 154(b) by 173 days.

(21) Appl. No.: 09/985,217

(22) Filed: Nov. 2, 2001

Related U.S. Application Data

(63) Continuation-in-part of application No. 09/103,686, filed on Jun. 17, 1998, now abandoned, which is a continuation of application No. 08/759,308, filed on Dec. 2, 1996, now abandoned.

(51) Int. Cl.[7] ..... G08B 23/00

(52) U.S. Cl. ..... 340/573.1; 340/573.4; 340/539.1; 340/539.13; 340/539.16; 340/539.2; 340/825.49; 379/38

(58) Field of Search ..... 340/573.1, 573.3, 340/573.4, 572.1, 539.1, 539.13, 539.16, 539.2, 825.36, 825.49, 10.1; 379/38, 44

(56) References Cited

U.S. PATENT DOCUMENTS

| | | | | |
|---|---|---|---|---|
| 4,656,463 | A | 4/1987 | Anders et al. | 340/572.1 |
| 4,750,197 | A | 6/1988 | Denekamp et al. | 379/58 |
| 4,918,425 | A | 4/1990 | Greenberg et al. | 340/539 |
| 4,952,913 | A | 8/1990 | Pauley et al. | 340/573 |
| 5,051,741 | A | 9/1991 | Wesby | 340/825.49 |
| 5,115,224 | A | 5/1992 | Kostusiak et al. | 340/574 |
| 5,255,306 | A | 10/1993 | Melton et al. | 379/38 |
| 5,289,372 | A | 2/1994 | Guthrie et al. | 364/403 |
| 5,339,074 | A | 8/1994 | Shindley et al. | 340/825.31 |
| 5,363,425 | A | 11/1994 | Mufti et al. | 379/38 |
| 5,408,238 | A | 4/1995 | Smith | 342/357 |
| 5,455,851 | A | 10/1995 | Chaco et al. | 379/38 |
| 5,465,082 | A | 11/1995 | Chaco | 340/825.54 |
| 5,469,170 | A | 11/1995 | Mariani | 342/51 |
| 5,525,967 | A | 6/1996 | Azizi et al. | 340/573 |
| 5,543,797 | A | 8/1996 | Hochstein et al. | 342/42 |
| 5,596,313 | A | 1/1997 | Berglund et al. | 340/574 |
| 5,742,237 | A | 4/1998 | Bledsoe | 340/825.49 |
| 5,890,068 | A | 3/1999 | Fattouche et al. | 455/456 |
| 6,121,926 | A | 9/2000 | Belcher et al. | 342/450 |
| 6,127,976 | A | 10/2000 | Boyd et al. | 342/463 |
| 6,150,921 | A | 11/2000 | Werb et al. | 340/10.1 |
| 6,211,781 | B1 * | 4/2001 | McDonald | 340/505 |
| 6,307,475 | B1 * | 10/2001 | Kelley | 340/573.1 |
| 6,433,687 | B1 * | 8/2002 | Yamaashi et al. | 340/573.1 |
| 6,483,461 | B1 * | 11/2002 | Matheney et al. | 342/463 |

* cited by examiner

*Primary Examiner*—Toan Pham
(74) *Attorney, Agent, or Firm*—Jacobson Holman PLLC

(57) ABSTRACT

A device and system for locating, positioning and monitoring an object or an individual comprising a transmitter member attached to the object or individual having a preset encryption code, radio frequency and preset range for the radio frequency, a power source and a process timer for programming the frequency interval for transmission, at least one transceiver member positioned within range of the transmitter and in communication with a host central processing unit having database software capability and mapping software capability. The system may further include an automatic shutdown module for initiating a sleep mode in response to either an absence of motion or continuous motion, a transmit counter for automated tracking of transmitter battery life, and an automatic peripheral data interface for communicating peripheral data with the location transmissions.

22 Claims, 15 Drawing Sheets

LOCATION, POSITIONING, AND MONITORING SYSTEM
TRANSMITTER BLOCK DIAGRAM

METHOD, APPARATUS AND SYSTEM FOR TRACKING, LOCATING AND MONITORING AN OBJECT OR INDIVIDUAL

This application is a continuation-in-part application of U.S. Ser. No. 09/103,686, filed Jun. 17, 1998, abandoned which is a continuation of U.S. Ser. No. 08/759,308, filed Dec. 2, 1996 abandoned.

BACKGROUND OF THE INVENTION

1. Field of the Invention

The present invention is directed to a system, method and apparatus for positioning, locating and monitoring an object or an individual.

2. Description of the Related Art

The use of systems and methods to monitor the movements and locations of a variety of objects, including individuals, pets, items of personal property or manufactured items is well known. However, the manner in which prior systems or methods operated have many drawbacks and were not appropriate for continued use and continuous updating. For example, previous devices such as car or house key locators have been offered to the public, but are simply switch-on switch-off units which do not offer the sophistication nor variation of the present invention for identifying position, location and the monitoring of an item. Similarly, another method utilized is two-way communications with infrared devices which are bulky, expensive, and easily damaged.

Still further, certain of the prior art systems were designed only to provide for a location service when the remote transmitter was in range of the central receiver. Thus, if both transmitter and receiver were mobile, it is possible that neither would come within range of the other, for location purposes.

U.S. Pat. No. 5,469,170 to Mariani relates to remote, electronic identification using an RF tagging device. This method is commonly referred to as a passive surface acoustic wave process and the maximum number of different and discrete code addresses is 1,000,000. The maximum distance of operation for the system as described in this patent is approximately 10 feet.

U.S. Pat. No. 5,289,372 to Guthrie identifies a tracing device which uses sensors and collectors. Each sensor is coupled to a selected set of sensors, a concentrator coupled to a plurality of collectors and a computer having a database for storing sensor data is coupled to the concentrator by way of a communication link. The communication of data is by a hard-wired network and would appear that the maximum number of sensors for this patent would be 6,656, all hard wired.

U.S. Pat. No. 5,525,967 to Azizi uses a tracing transceiver unit and a target transceiver unit. The premise of this patent is to track an object while wearing the target transceiver with the object having the tracking transceiver secured thereto. The unit identifies the distance to the tracking unit by means of calculating the time it takes to receive the response signal. It operates at a very low frequency and would appear that the tracking transceiver can identify one target transceiver at a time. There is no interface disclosed which provides for the storage and processing of data involved with more than one object.

U.S. Pat. No. 5,363,425 utilizes existing PBX and telephone communications switching networks for data communication. The type of tracking disclosed is designed to track personnel within an office complex and redirect their telephone calls.

U.S. Pat. No. 5,339,074 identifies a tracking device which uses a proximity detector sensor for identifying a unique RF signal. It is primarily an identifier allowing only certain individuals access to a particular location or access and operation of a computer machinery or other item. In other words if the identification number matches, the individual is permitted access to the area or piece of equipment.

OBJECTS OF THE INVENTION

An object of the present invention is to provide for a novel method, apparatus and system for locating, positioning or monitoring objects or individuals, the system being automatic and requiring no hand scanning of identification tags.

Another object of the present invention is to provide for a novel locating, positioning and monitoring system which has the capacity to locate the position of or monitor significantly more objects or individuals than the prior art.

A still further object of the present invention is to provide for a novel locating, positioning and monitoring system having greater range than the systems identified in the prior art.

A still further object of the present invention is to provide for a novel locating, positioning and monitoring system in which battery life is extended with respect to the identification tag by means of an internal microchip timer which maintains a power standby mode except when triggered to transmit.

A still further object of the present invention is to provide for a novel locating, positioning and monitoring system which eliminates the labor intensive process of hand scanning or fixed scanning of an object or individual.

A still further object of the present invention is to provide for a location, positioning and monitoring system which incorporates a data address encryption and decryption mode in the data positioning algorithm permitting the accommodation of significantly more objects or individuals in the system.

Another object of the invention is a real-time asset tracking system for locating, positioning and monitoring in which active transmitters automatically power-down in response to constant motion or an absence of motion for a specified duration of time, thereby conserving battery power.

A still further object of the invention is a real-time asset tracking system incorporating circuitry for monitoring a number of transmitter transmissions in order to track battery life.

Yet another object of the invention is an automatic peripheral data interface for use with the real-time asset tracking system which enables status information of devices associated with active transmitters to be conveyed to a host device.

SUMMARY OF THE INVENTION

A device and system for locating, positioning and monitoring an object or an individual comprising a transmitter member attached to the object or individual having a preset encryption code, radio frequency and preset range for said radio frequency, a power source and a process timer for programming the frequency interval for transmission, and at least one transceiver member positioned within range of the transmitter and in communication with a host central processing unit having database software capability and mapping software capability.

The position, locating and monitoring system of the present invention is generally designed to assist a user to acquire position, location and monitoring status of an object or individual in which a position, locating and monitoring system member is secured to a main part thereof. This system is especially useful for determining the location, position and monitoring status of parts, products, containers, cartons and the like in the manufacturing and distribution environment. It can also provide for location and status of personnel and their movement and condition.

As an example, when the position, location and monitoring system is installed within a manufacturing facility and the product and or objects are fitted with a transmitter portion of the system, with transceiver units installed at various locations within the facility, all products and assets or objects can be tracked within the facility through a central processing unit in communication with the transceivers and the transmitter secured to the objects and or product.

Each transmitter unit which is attached or affixed to, secured or carried by a particular object and or personnel, will transmit a unique code. The transmission time periods of the code are adjustable and random. The code generated by the transmitter encoder can be developed for either binary or a tri-state code encryption, for example $\mathbf{2}^{12}$, $\mathbf{2}^{18}$, $\mathbf{2}^{29}$, $\mathbf{3}^{12}$ or $\mathbf{3}^{18}$.

The transmitted code is received by one or more of the transceivers located within the facility. The transceivers will "interrogate", i.e., validate, the data signal received and forward this information to the central processing unit (CPU). The telemetry methods for the relay of this information can be of various types such as line to line, cellular, RF, infrared or satellite. Once the information is received by the CPU, the data is stored in mass memory for use with the developed database software and digital mapping software.

The advantage of the present locating positioning and monitoring system over the other conventional transmitter receiver technology is that a radio transmitter requires that the device always be in a power-up mode. This circuit design results in shortened battery life. The circuitry of the present invention allows the device to be in a power-standby mode except when triggered to transmit. The power-on mode is automatic and generated by an internal surface-mounted microchip timer. This allows the locating positioning and monitoring system to transmit using a much smaller battery supply which, in turn, will last for a longer period of time.

Another difference and improvement in the present invention is the incorporation of data address encryption and decryption in the data positioning algorithm. These improvements allow for the development of a method, system and apparatus which is capable of locating, positioning and monitoring objects or individuals in a continuous manner, and updating with regularity the status of the object or individual.

The present further includes a real-time asset tracking system with active transmitters having electronic circuitry and motion sensor capability which together serve to detect periods in which the transmitter is either motionless, or subject to constant motion, for a specified period of time and, in response to either condition, power-down the transmitter for battery life conservation.

An automatic RF transmit counter may also be incorporated into the real-time asset tracking system. Such transmit counter tracks and stores a total number of transmissions in order to estimate remaining battery life. When a total number of transmissions approaches a predicted battery life limit, the battery may be conveniently replaced prior to actual failure.

The present invention also includes an automatic peripheral data interface allowing communication of specified data between a device being tracked and the transmitter unit being used to track such device. Through the inventive interface, status information pertaining to the device can be included in data transmissions from the transmitter unit to a central host device.

BRIEF DESCRIPTION OF THE DRAWINGS

These and other objects of the present invention will become evident particularly when taken with the following drawings which illustrate the locating, positioning and monitoring system.

DETAILED DESCRIPTION OF THE DRAWINGS

Figure 1A:
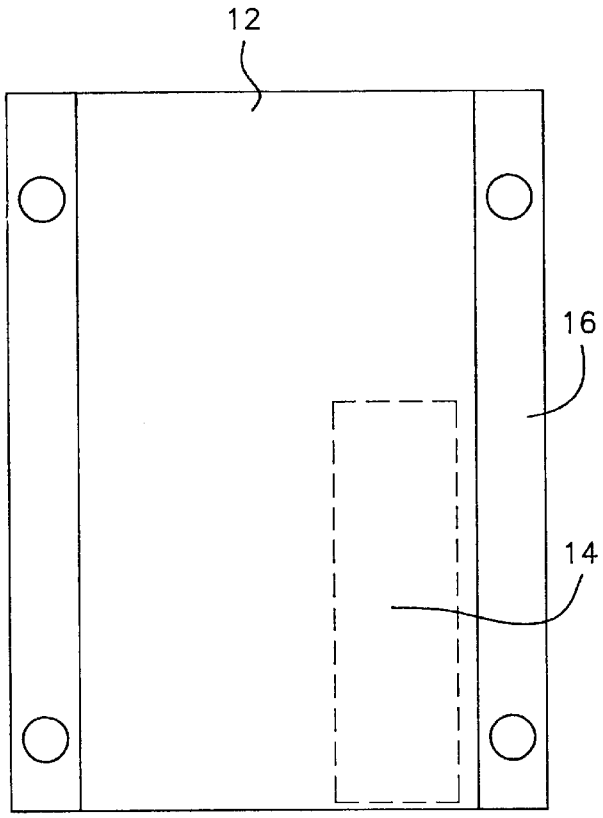
FIG. 1A is a top view of the transmitter approximating its actual size.
Figure 1B:
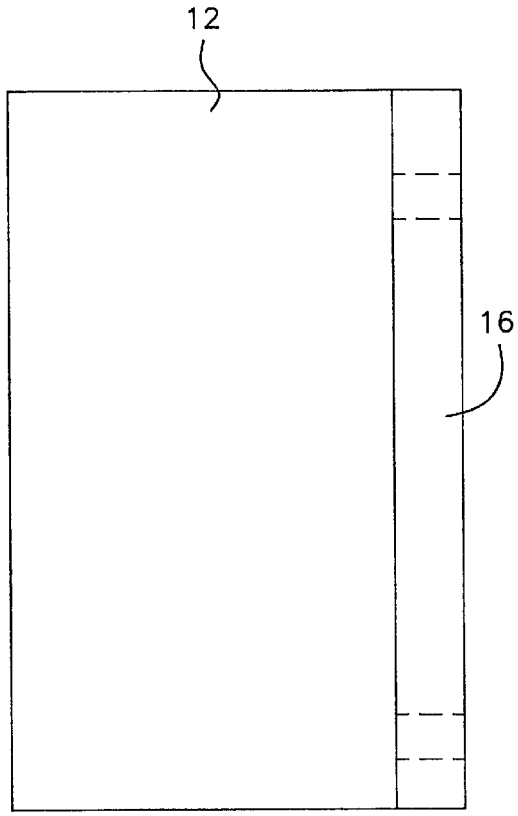
FIG. 1B is a side view of the transmitter approximating its actual size.
Figure 1C:
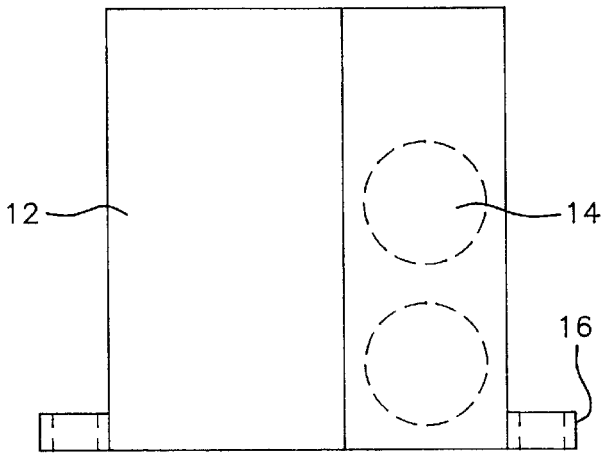
FIG. 1C is an end view of the transmitter approximating its actual size.

FIGS. 1A, 1B and 1C illustrate top, side and end views, respectively, of the transmitter housing 10. The transmitter housing 10 is generally rectangular in cross section having a battery receptacle 12 for receipt of a power source in the form of a battery 14. The circuitry of the system provides for a longer battery life with respect to the power source for the transmitter as will be more fully discussed hereinafter. Additionally, the transmitter is formed with mounting flanges 16 to permit the mounting of the transmitter to a pallet or other object.

To begin use of the transmitter, an operator, as he places a product or asset on a pallet or physically locates or positions a large asset to which the transmitter is secured, would typically prepare the load sheets in the normal manner and also input the pallet ID or object ID to the central computer after which the tracking of the asset and or product would become an automated process.

Figure 2A:
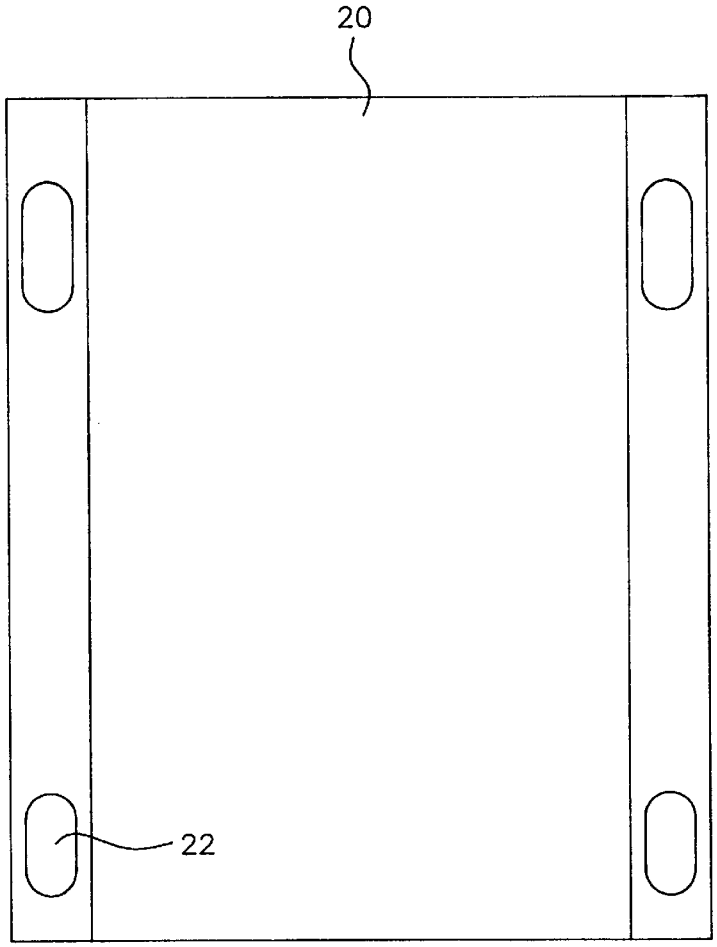
FIG. 2A is a top view of the transceiver approximating its actual size.
Figure 2B:
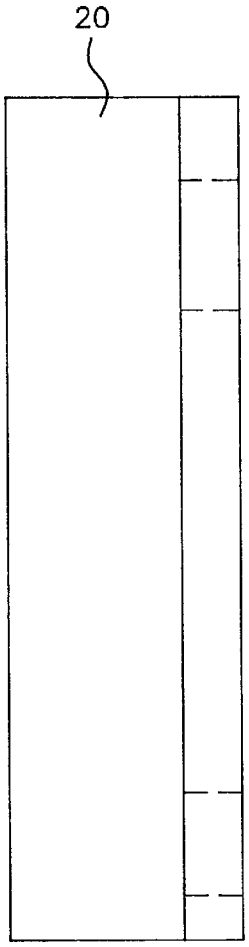
FIG. 2B is a side view of the transceiver approximating its actual size.
Figure 2C:
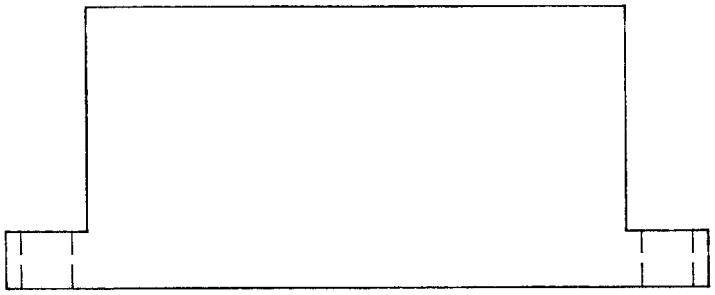
FIG. 2C is an end view of the transceiver approximating its actual size.

FIGS. 2A, 2B and 2C are top view, side view and end views of the transceiver member 20. The transceiver member 20 is generally rectangular in cross section and also includes and is formed with mounting flanges 22 for mounting the transceiver to a fixed position. For example, within a warehouse facility, the transceiver would be positioned on a wall or column within the facility. Depending upon the layout of the facility, the correct number of and distance between transceivers can be calculated to ensure positioning of transceivers so as to fully cover the entire facility. The more closely spaced the transceivers, the more accurately the object or individual can be located utilizing the mapping software described hereafter. For example, if a particular area of a warehouse housed large objects, that particular area could be monitored with transceivers spaced more infrequently about the area. If a particular area of the warehouse dealt with objects of smaller size or that were more numerous in quantity, the number of transceivers in that particular area could be increased to more accurately identify the location of the desired object.

Figure 3:
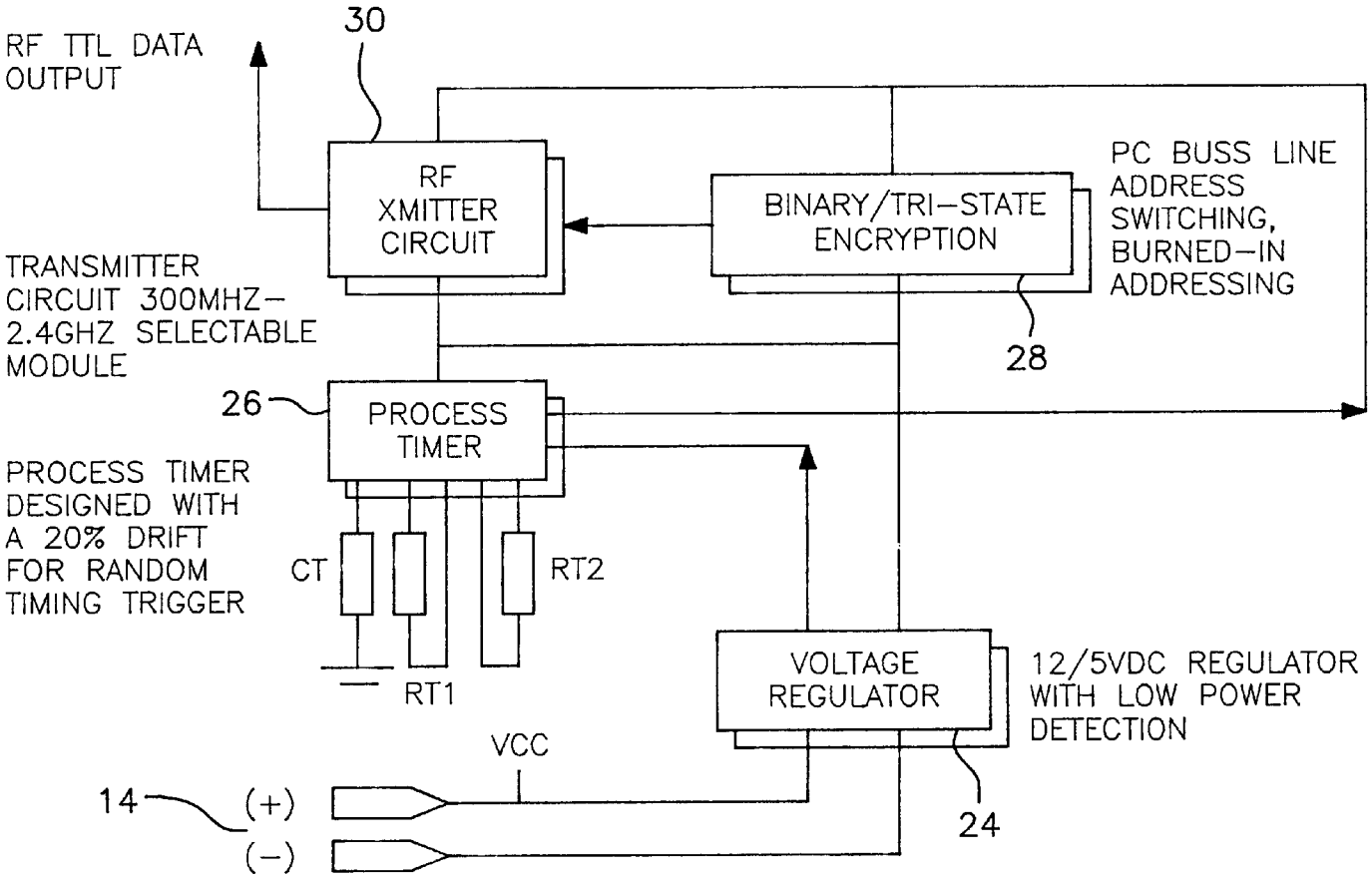
FIG. 3 is a block diagram identifying the transmitter design.

FIG. 3 is a block diagram of the transmitter 10. The key elements of the transmitter 10 include the power source 14 in communication with a voltage regulator 24. Transmitter 10 also includes a process timer 26 which can be programmable for signaling in order to report the location of the asset at preset intervals; these intervals can range from as frequently as one minute to one day or one week intervals. The frequency of the signaling interval will therefore affect the attendant battery life. The longer the time between transmission the longer the battery life. In practice, it has been found that if the transmitter is set for a transmission interval of once per day, the estimated battery life of two AA batteries would be approximately 80 consecutive days or approximately three months. A once-a-week reporting interval would extend the battery life to approximately one year. The overall system is programmable to keep track of each transmitter and the transmission time and interval, and a running calculation of battery life remaining and replacement status for each transmitter is maintained at the central computer unit.

An additional element of the transmitter 10 includes the binary/tri-state encryption unit 28 which contains the encryption code dedicated to the particular transmitter, each transmitter having its own particular code allowing this particular system to handle a substantially greater number of objects or individuals over that disclosed in the prior art. The last element of the transmitter is the RF transmitter circuit 30 which would transmit the encryption code for the particular transmitter to a transceiver 20 dependent upon the signaling interval programmed into the process timer 26. Each transmitter is discretely identifiable. Each transmitter has its own discrete particular encrypted signal. Therefore, when an operator affixes a transmitter to an object and/or asset, he notifies the central processing unit that the particular transmitter has been affixed to a particular object or asset. The identification code for that transmitter is then stored within the central processing unit. Due to the capacity of the present system, if a facility initially operates with a thousand transmitters and requires the expansion of its facility and the addition of new transmitters, then additional transmitters can be provided which are identified and encrypted beginning with the last identification and encryption of the previously purchased transmitters. Due to the capacity of the encryption unit, the present system can provide for and accommodate substantially more objects and individuals than previous systems.

Figure 4:
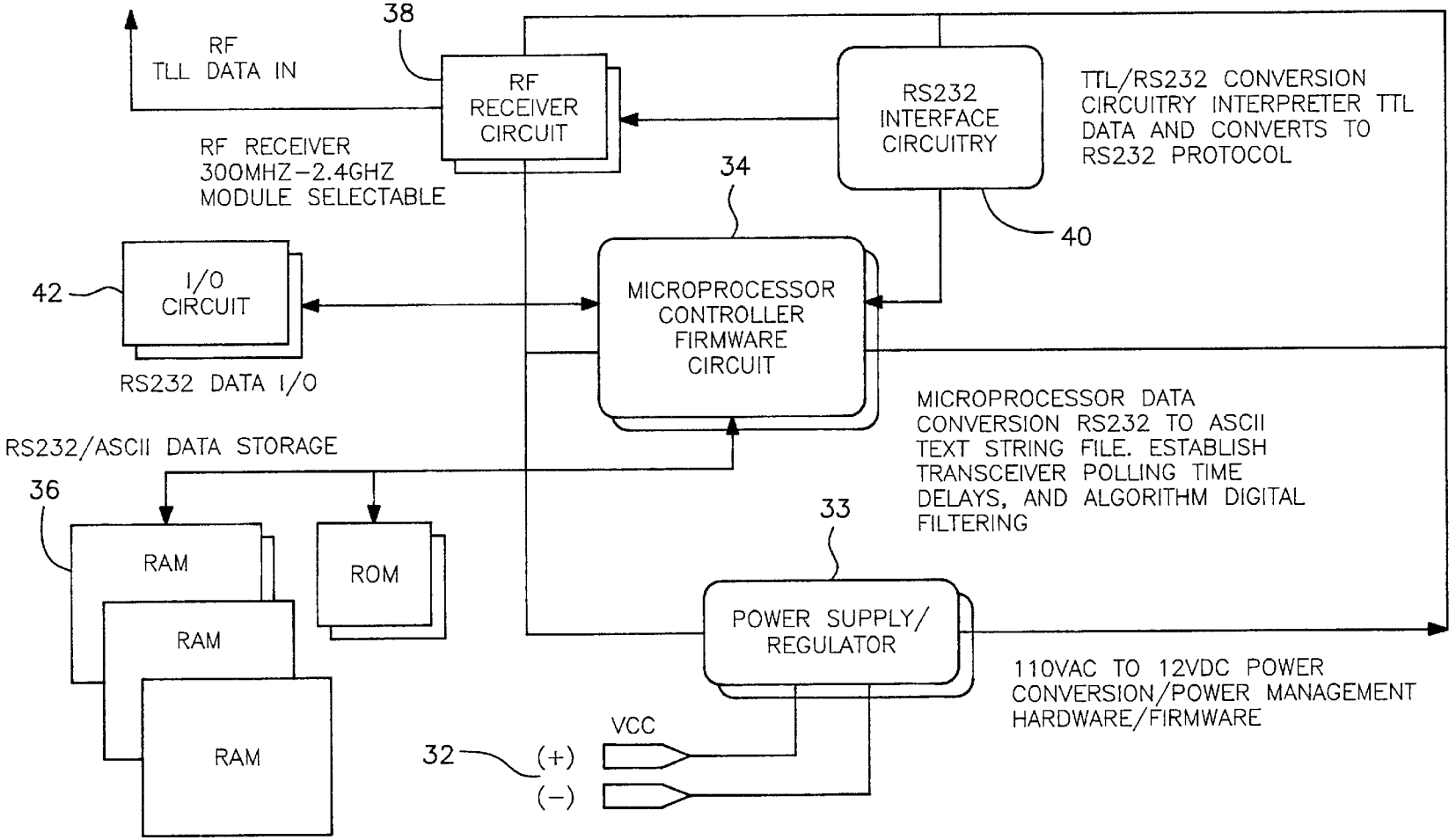
FIG. 4 is a block diagram identifying the transceiver design.

FIG. 4 is a block diagram of the transceiver unit 20.

The transceiver 20 is preferably connected directly to a power source 32 but would have a battery pack back-up power source to prevent the loss of data in the event of a power outage. A power supply regulator 33 would convert the direct energy source to 12 volt direct current for internal operation of the transceiver 20. The transceiver 20 contains a micro processor 34 secured to a data storage member 36. RF signals from the transmitters 10 would be received by local transceivers 20 by means of an RF receiver circuit 38. This input data would be communicated to an interface circuitry unit 40 for conversion to the transceiver protocol, then directed to the micro processor 34 where the information would then be directed either to date storage 36 or in combination to data storage 36 and to an input/output circuit 42 for communication with the central processing unit.

Figure 5:
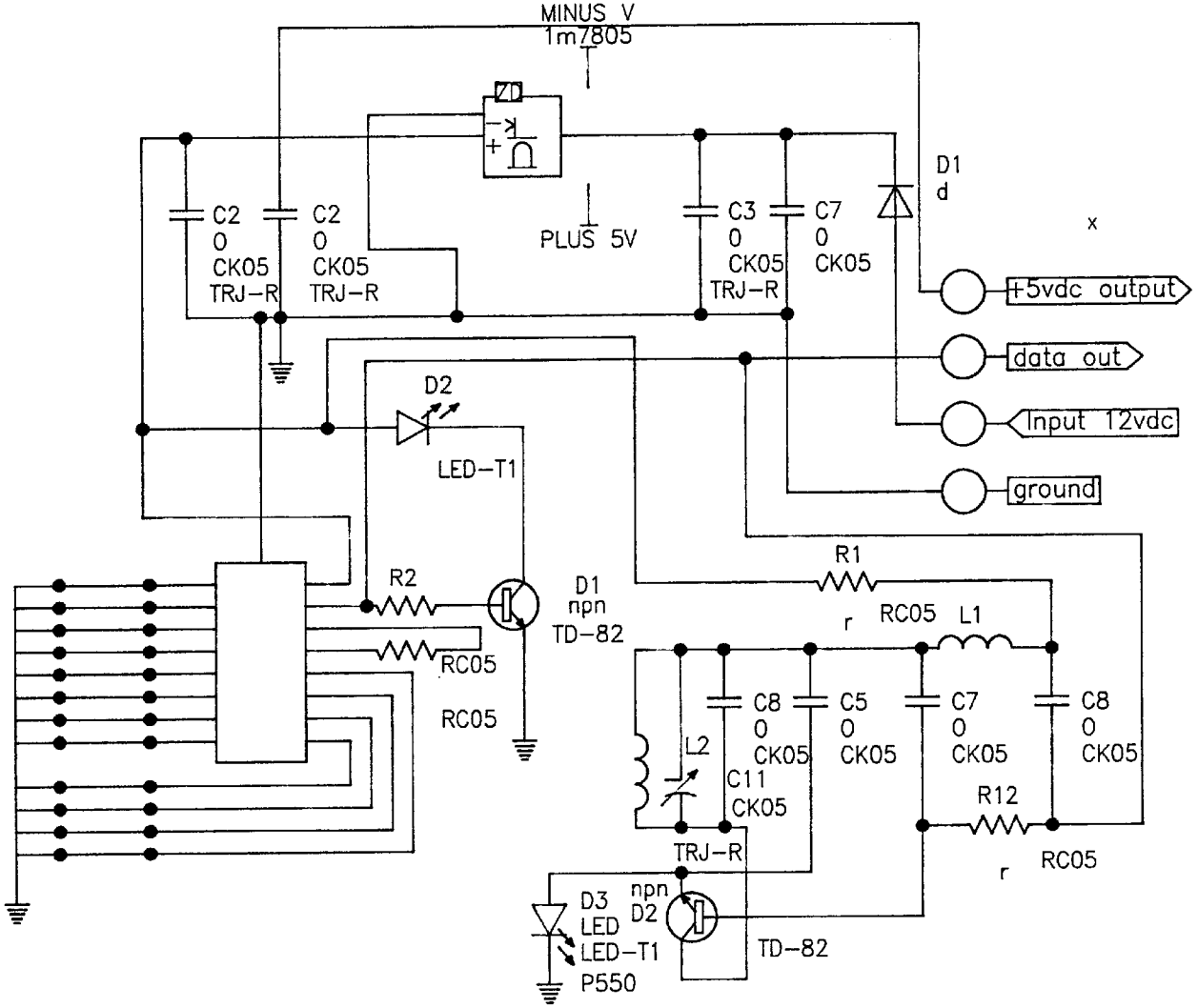
FIG. 5 is a schematic diagram illustrating the circuitry of the transmitter member.
Figure 6:
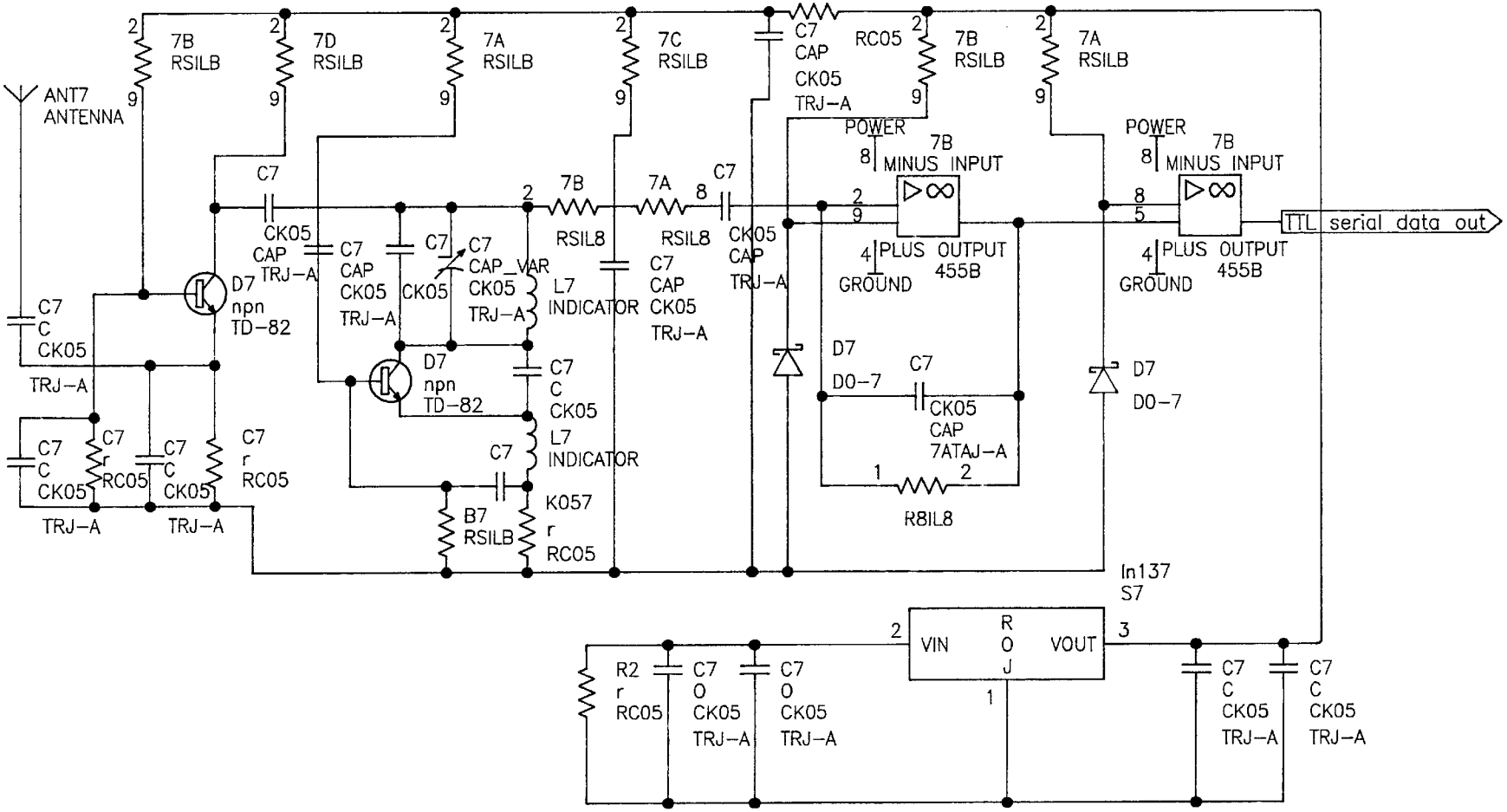
FIG. 6 is a schematic diagram of the circuitry of the transceiver member.

FIGS. 5 and 6, respectively, are the circuit diagrams of the transmitter member 10 and the transceiver member 20. These illustrations complement FIGS. 3 and 4 which are the block diagrams of the operational modes of these two members.

The encoder microchip 28 of transmitter 10 uses either a binary or tri-state address code encryption. The RF transmitter is set for an RF power output of equal to or less than 250 Mw or one watt output. Once the transmitter is activated, either by attaching to a power source or by attachment to an object or asset, the transmitter is armed. Once armed, each transmitter will transmit a unique encryption code address. Due to the encryption algorithm, the system can develop and track 536,870,911 addresses before it is necessary to recycle addresses. The transmit cycle is determined by the process timer 26 and can be set dependent upon customer requirements. Once the frequency interval for signaling is set, the process timer 26 is designed for +/−20 percent drift from the set time. This percentage drift is designed in the transmitter to minimize transmission collision between a multitude of transmitters signaling to a transceiver. Further, the transmitter is designed such that during off-transmission periods all components of the transmitting unit will be at 0 current state except for the process timer 26. This process minimizes battery drain and extends the transmission service life.

The transceiver 20, once installed, is in an armed mode at all times. In a preferred embodiment, the transceiver is hard-wired for power, but contains a battery backup in the case of power outages in order to ensure that no data is lost.

When a data signal is received from a transmitter, the transceiver undertakes to perform several discrete functions. First, the transceiver 20 will interrogate the signal to validate that what is being received is valid location, position and monitoring data. This step is performed by a unique proprietary check-sum algorithm. If all data components of the incoming RF data signal match the embedded algorithm, the signal is considered to contain valid data. The transceiver will then transform the transistor to transistor logic (TTL) to ASCII standard protocol. This is accomplished by the use of the microprocessor 34. The transistor to transistor logic data is read in by the microprocessor and the "0" and "1" logic states are analyzed to generate the ASCII conversion. The transceiver will then store the ASCII code in its own memory, assigning it a header or preamble. As such, a data string will develop with respect to each particular transmitter. This data can then be retransmitted, either by hardwire or telemetry, to the host central processing unit. The data transmission baud rate is variable and can be set between the existing parameters.

The data received by the host central processing unit is stored in mass memory. The central processing unit will have a programmable cycle which will poll all transceivers which are installed in the facility. The data stored in the central processing unit will be used by data base and mapping software. The data stored contains the following information or fields: (1) transceiver identification, (2) transmitter identifications. The database software will be utilized to validate, and cross reference either a single object, asset or group of objects or assets which are associated with a single transmitter identification. The mapping software would be utilized to display a digital floor plan of the facility. The floor plan would outline the physical locations of all transceivers installed and their associated areas for receipt of incoming transmitter data. The location, position and status of any particular object associated with a transmitter would be displayed on the central processing unit monitor showing its location, position and status. As the object or asset is moved through the facility, its motion is automatically displayed with the status, time and date of movement. It should be noted that the information provided by the transmitter, and validated by the transceiver and processed by the central processing unit can also aid in the automatic generation of invoices, loading plans, manifests, shipping lists or other processes which are normally generated through the manual mode of operation.

Figure 7:
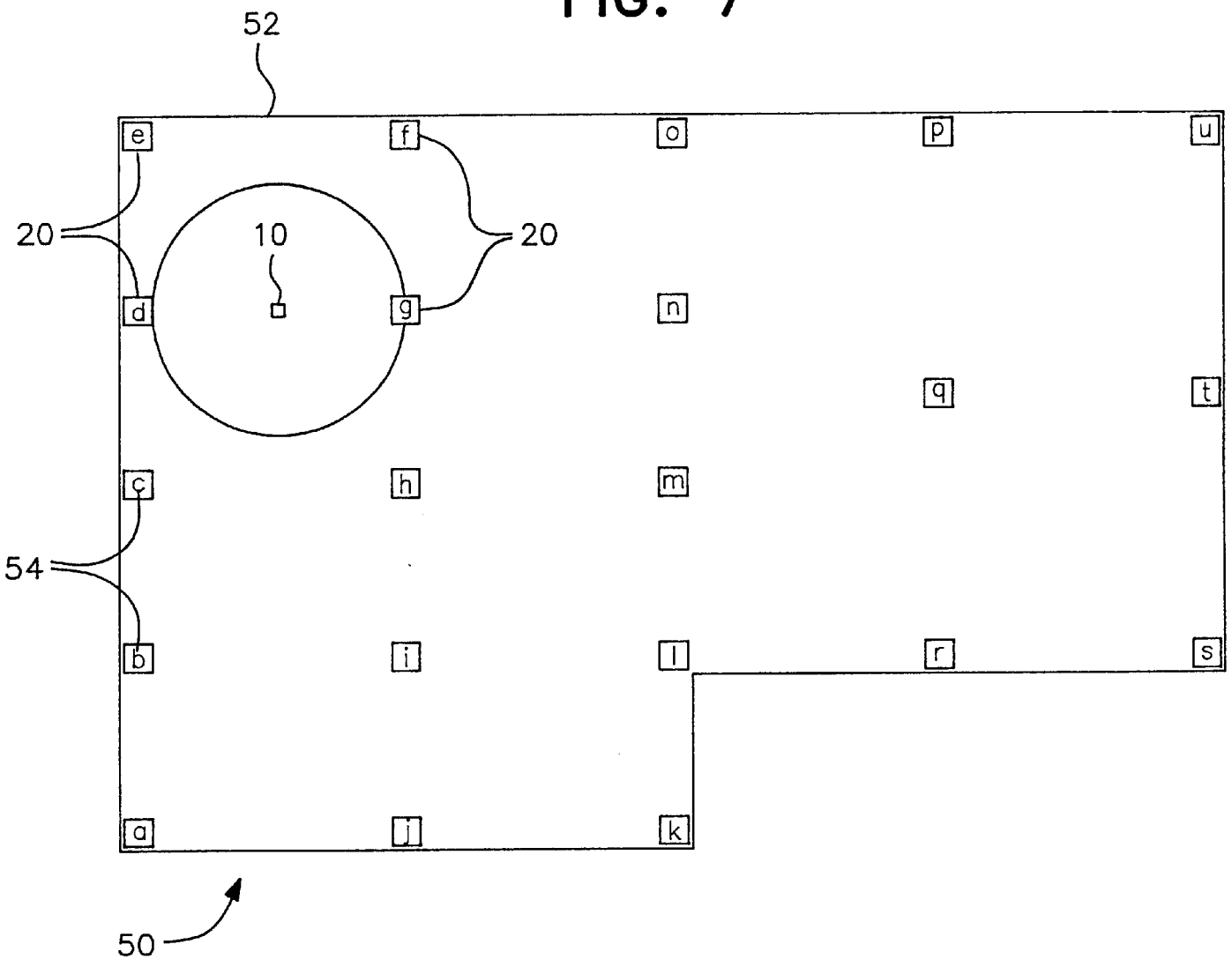
FIG. 7 is a schematic design illustrating the locating, positioning and monitoring system within a warehouse facility.

FIG. 7 is a schematic diagram showing the manner in which the locating, positioning and monitoring system would perform within a typical manufacturing or warehouse facility. This example is illustrative of the system within an enclosed facility, but the system performs just as accurately and in the same manner in an open area or combination open and enclosed area, as will be discussed hereinafter.

In FIG. 7, the facility 50 is prescribed by a peripheral outer wall 52 which would normally be covered by a roof (not shown) and the roof being supported by columns or pillars 54 positioned about the inner periphery of facility 50 or in the interior of the facility and identified sequentially at Columns a through u. The interior periphery wall and the interior columns of the facility provide locations for positioning transceivers 20. Depending upon the spacing of the transceivers and the size of the facility and the desire of the operator to locate an object to within plus or minus a certain distance, the number of transceivers 20 would be spaced accordingly. In the example illustrated in FIG. 7, a transmitter 10 is affixed to an object or pallet within the facility. In the example, the object with the transmitter 10 attached thereto is shown within range of transceiver 20*d* and transceiver 20*g*, assuming that all of the transceivers within the facility are set to the same distance. Therefore, the operator at a central processing unit can identify the location of the object associated with transmitter 10 through the mapping software as being located between transceivers 20*d* and 20*g*. In the example illustrated in FIG. 7, if the range of the transceivers were increased, it is possible that the object associated with transmitter 10 would also come within the range of transceivers 20*e* and 20*f*. If that were the case, the operator would then have four transceivers with which to locate the object associated with transmitter 10 and the particular location of the object could be narrowed down to an even more narrow scale.

Figure 8:
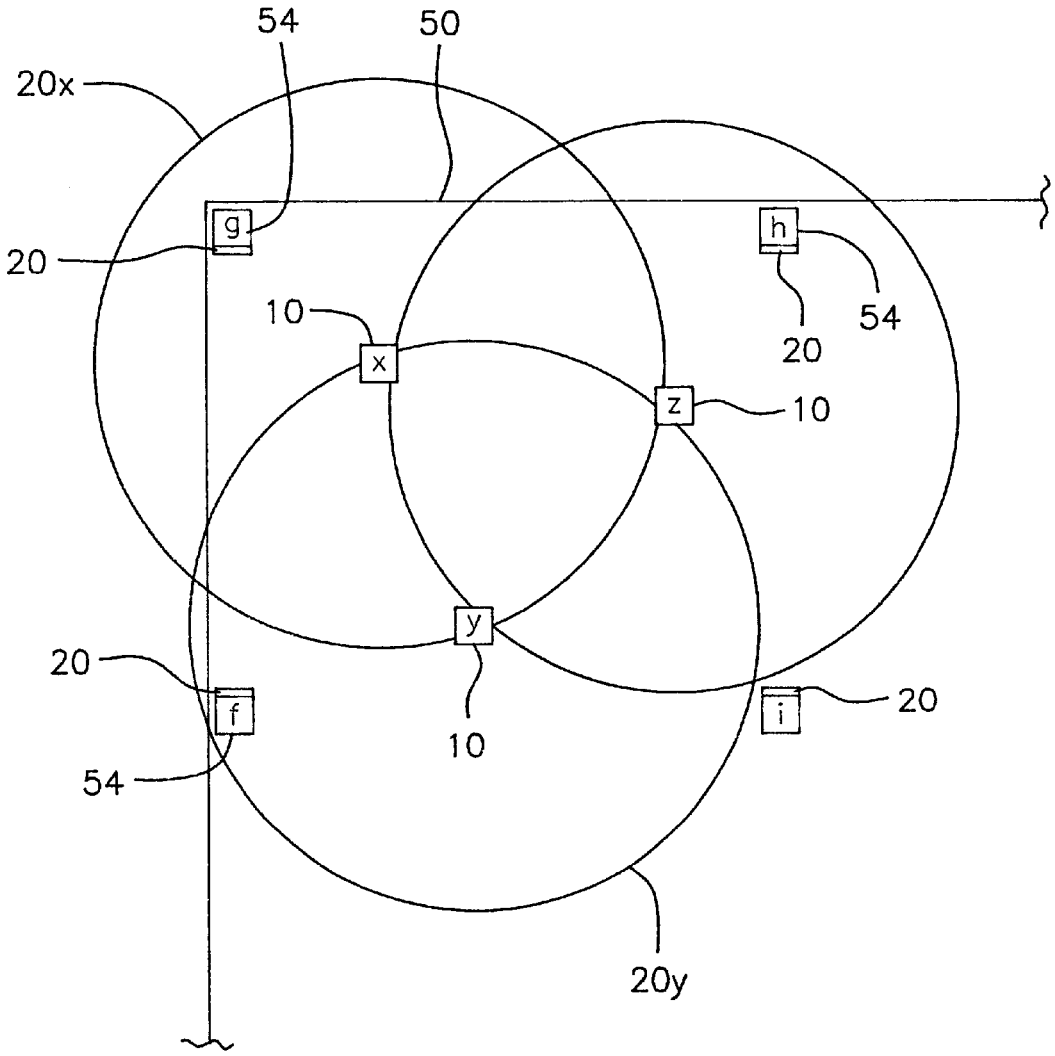
FIG. 8 is a schematic design illustrating the locating, positioning and monitoring system utilized in an indoor and outdoor setting such as a theme park for the locating, positioning and monitoring of individuals.

FIG. 8 illustrates the utilization of the novel location, positioning and tracking system with respect to individuals. In this example, three individuals, x, y and z are provided with an addressable transmitter having a unique identification code which could be clipped to their wrists or belt. The transmitter could be as small as a name tag or a wristband. The range of the transmitter would be preset. Transceivers 20 would be positioned within the facility or on the grounds of the facility such as a theme park. The unique identification codes of each transmitter would be received by the transceivers 20 as the individual moved about the facility or grounds and came within range of a particular transceiver. In the example illustrated in FIG. 8, individual x would be located and identified by transceiver 20*g* since that transceiver is within range of the transmitter range as evidenced by the circle 20*x* representing the transmitter range. Similarly, individual y can be located either by transceiver 20*f* or 20*i* since individual y is positioned between these two transceivers and the transmitter range identified by transmitter circle 20*y* would encompass both of these transceivers.

Figure 9:
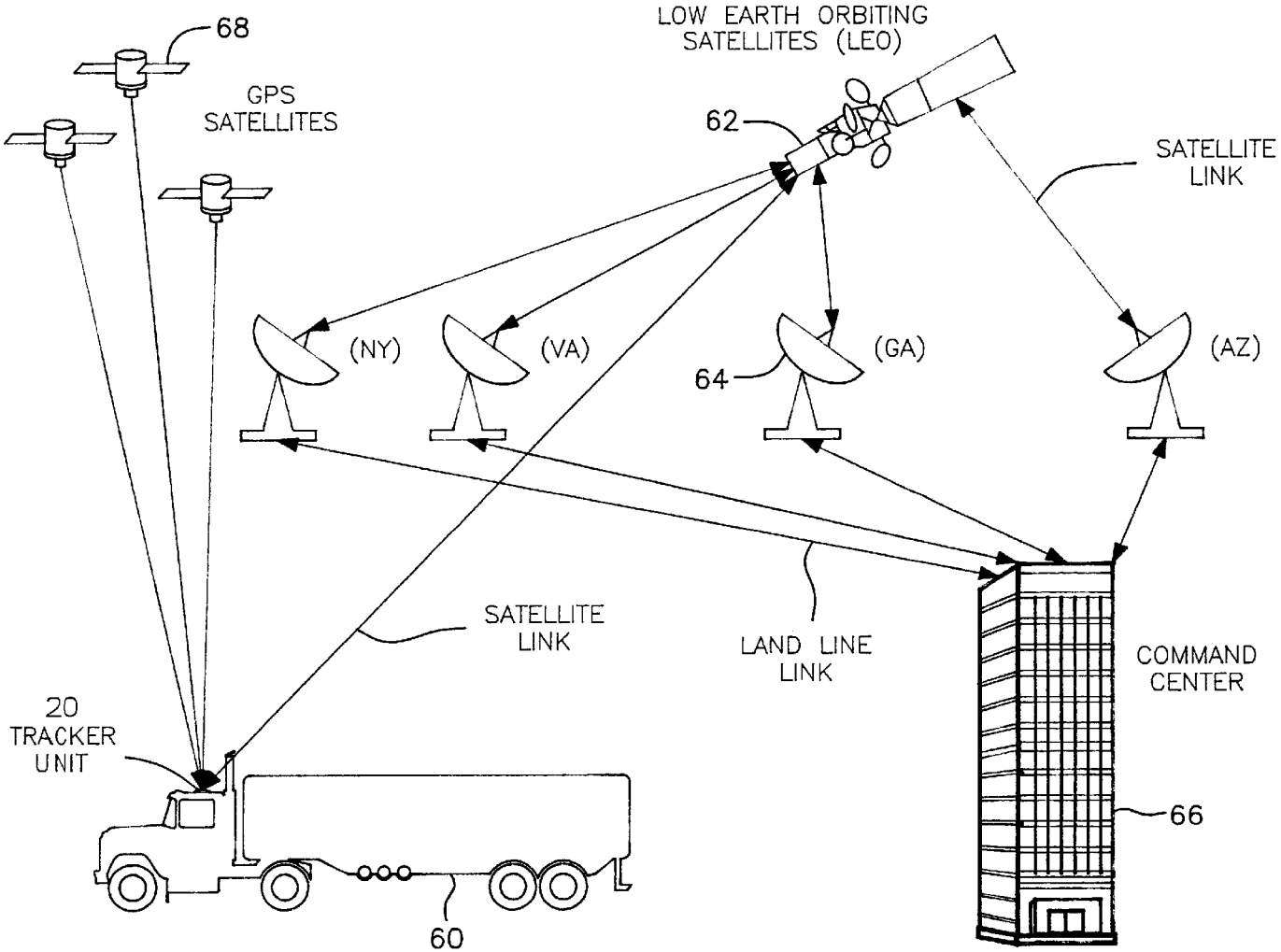
FIG. 9 is a block diagram of the locating, positioning and monitoring system utilized with respect to objects and or assets in a transportation mode, supplementing the system with satellite technology.

FIG. 9 is a block diagram illustrating the use of the locating, positioning and monitoring system in an exterior environment. In this particular illustration, the vehicle 60 would be transporting objects or assets. The objects or assets would have affixed to them the transmitter 10 either directly, or on the transport media to which the objects or assets are affixed. The vehicle 60 would have a transceiver unit 20 affixed to it. The transceiver unit 20 would be in communication with a low earth orbiting satellite 62. As the vehicle 60 delivered the assets or objects contained within it, the tracking units would communicate with the transceiver units 20 identifying which objects or assets were still on the vehicle and which were not. The transceiver unit 20 in turn would communicate the information to satellite 62 which would downlink the information to a receiving station 64 and transmit it to the command center 66 wherein a central processing unit would be positioned. Therefore, the central processing unit would be aware of the remaining contents of the vehicle 60 and could even program the data to identify the time in which an asset or object was delivered from vehicle 60 and thus removed from the range of the transceiver 20 affixed to the vehicle 60. This system could be supplemented through the use of the global positioning satellite network 68 to further refine and identify the location of the vehicle and the remaining assets.

Figure 10:
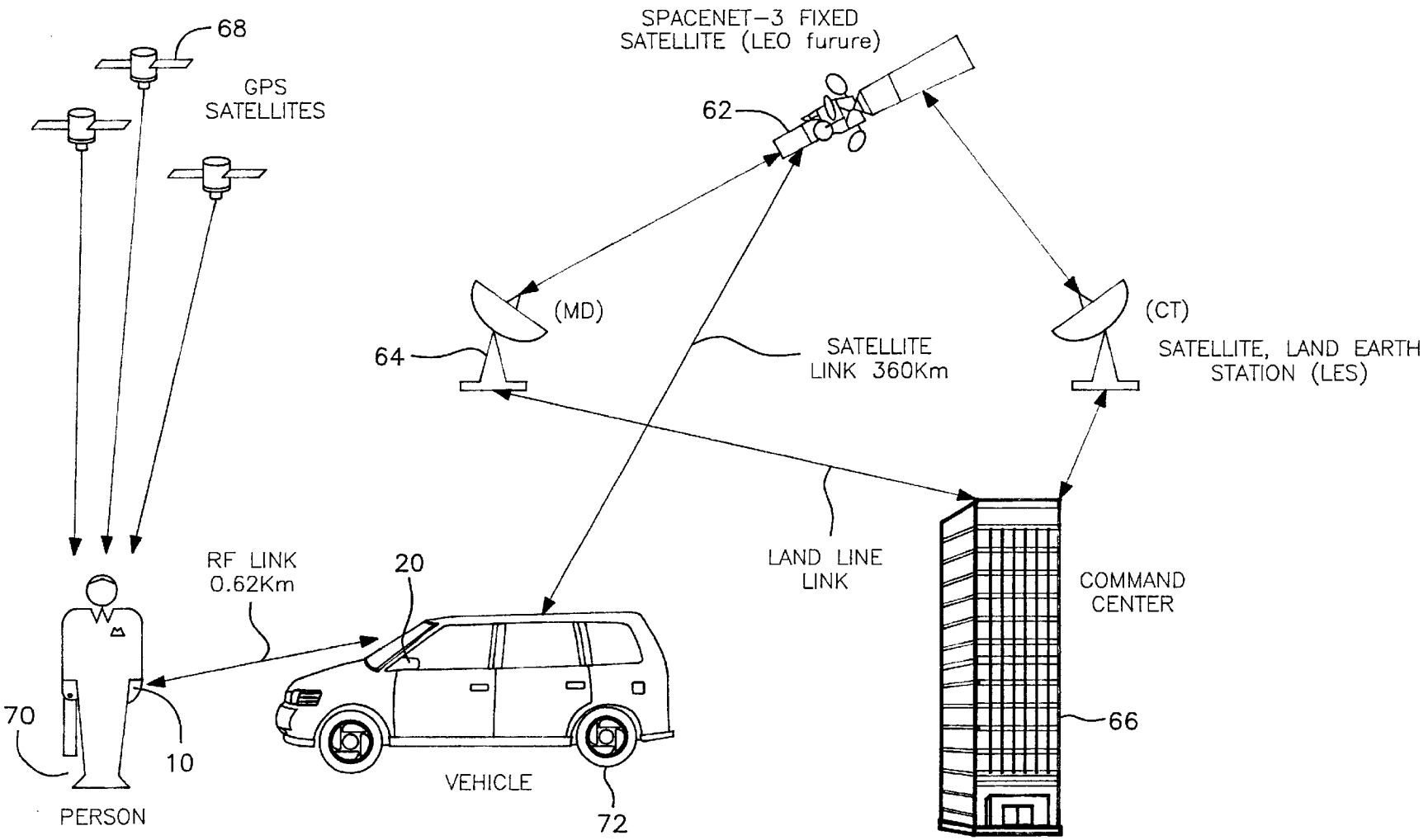
FIG. 10 is a schematic block diagram illustrating the locating, positioning and monitoring system within an indoor or outdoor setting for locating, positioning and monitoring of an individual.

FIG. 10 is a block diagram illustrating the use of the locating, positioning and monitoring system with respect to an individual in an exterior environment. In this particular instance, the individual 70 would be fitted with a tracking unit 10 having a preset programmed distance to permit communication with a transceiver unit 20 located within the individual's vehicle 72. Similar to the system identified in FIG. 8, the transceiver 20 in vehicle 72 would be in communication with a low earth orbiting satellite 62 which would downlink the information to a receiving station 64 which would transmit the information to the central processing unit at a command center 66. Again, this system could be supplemented with the use of the global positioning satellite network 68 to further refine and identify the location of the individual.

In each of these instances, the benefit from the locating, positioning and monitoring system of the present invention includes the fact that each of the tracking units is encoded with its separate identification number and the encoding encryption algorithm allows for the tracking and monitoring of substantially more tracking units than any previous system disclosed in the prior art.

The locating, positioning and monitoring system of the present invention includes a real-time asset tracking system (ATS) with active transmitters having a plurality of automatic functions which enhance the operation of the system. These enhancing functions include automatic shutdown, automatic RF transmission tracking and battery monitoring capability, and a peripheral data interface with automatic status tracking and transmission. Each of these will now be discussed in turn.

Figure 11:
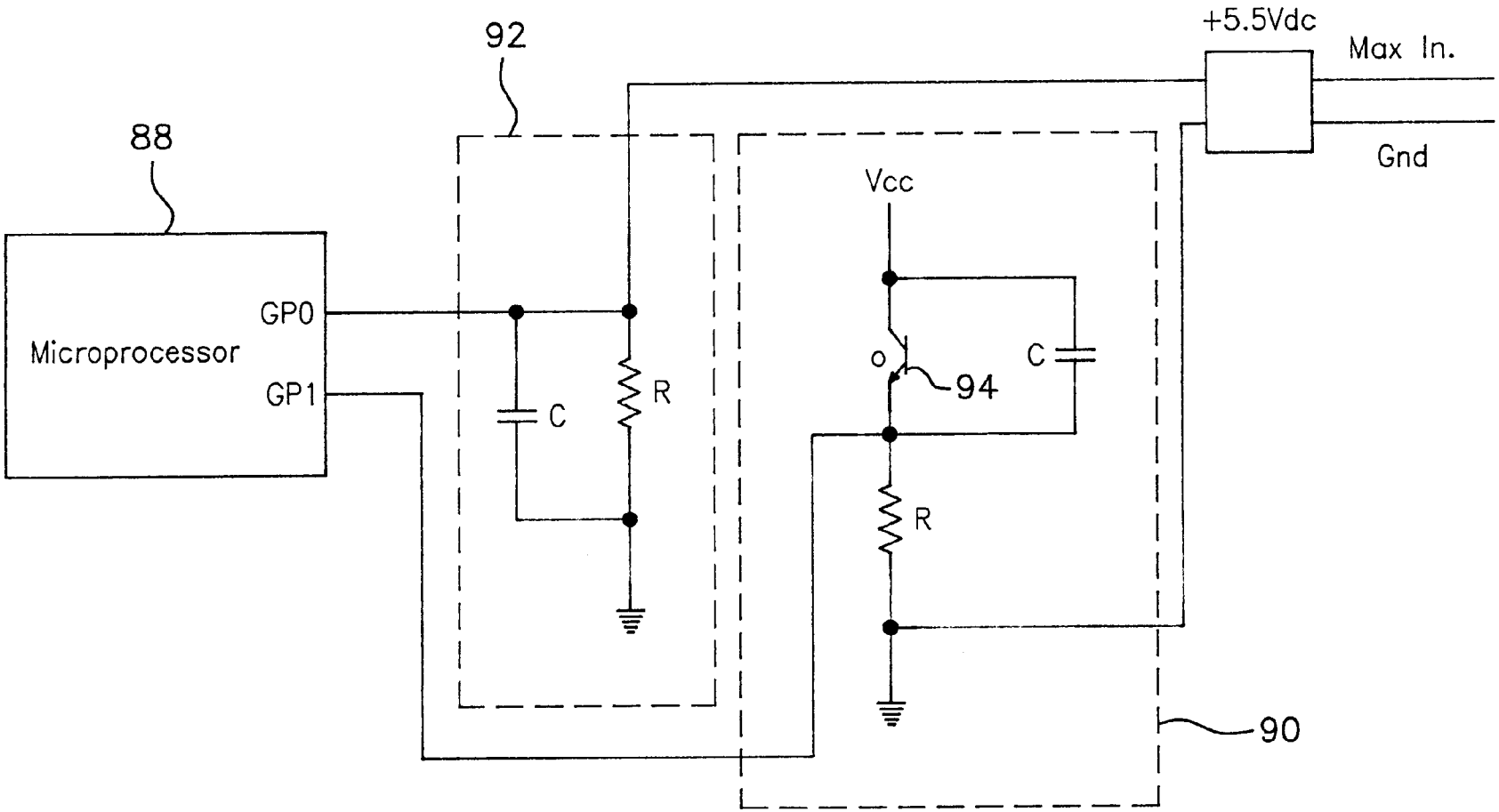
FIG. 11 is a schematic drawing of the automatic shutdown module and automatic peripheral data interface for use in the locating, positioning and monitoring asset tracking system according to the present invention.

In a preferred embodiment, the automatic shutdown function is provided through an automatic shutdown module (ASM) 90, shown in FIG. 11, which preferably incorporates electronic hardware and microprocessor firmware. As shown, the hardware representatively incorporates a resistor/capacitor (R/C) timing network with motion sensor accelerometer 94, connected to an input/output (I/O) port GP1 of the microprocessor 88. A second I/O port GP0 of the microprocessor 88 is connected to the automatic peripheral data interface circuitry 92.

The automatic shutdown module 90 is typically used in conjunction with an embodiment of the present invention in which, in addition to transmission at periodic intervals, movement of the transmitter triggers a transmission. As shown in FIG. 11, this detection of motion may be effected using a motion sensor accelerometer (MSA) 94. Whether the transmitter is operating in an automatic or a normal mode, with transmissions occurring automatically at preset or random intervals, or in response to motion, both of these modes represent what may be termed generally as the "transmission mode" of the transmitter, namely that state in which the transmitter has been sufficiently activated to allow initiation of a transmission. The transmitter may also enter a "sleep mode" which will be discussed further hereinafter.

When the transmitter is manufactured, it is placed in the sleep mode. The transmitter includes a pin or switch, referred to herein as the transmitter detent pin which, when activated, triggers the microprocessor to arm itself and go into the normal mode. The detent pin is depressed or turned "on" when the transmitter is attached to an object or individual.

Generally, the automatic shutdown module operates such that the transmitter or tag is automatically shut down, or triggered to move from the transmission mode to the sleep mode, when the accelerometer detects either an absence of motion or substantially constant motion for a specified time period. This is accomplished using an automatic transmission timer incorporating an R/C timer network.

In normal mode, if the microprocessor detects that the transmitter has been off and has not been motion triggered for longer than a specified period, four seconds for example, since the last transmission indicating motion, then the microprocessor polls the I/O port to identify the voltage present at the R/C network. If the voltage is greater than 33% of the capacitor's charge but is at least 33% less than the supply voltage (Vdd), the microprocessor goes into the sleep mode.

By connecting an R/C timing network to the digital I/O port of the microprocessor, this sleep function serves as a wake-up time delay circuit. The I/O pin is interrupt driven, so any change which reduces the voltage to less than 33% of the capacitor's charge level or increases the voltage to more than 67% of the supply voltage changes the state of the I/O pin and powers up the transmitter. Accordingly, in the absence of motion, the capacitor to allowed to discharge slightly below the 33% level, thus waking the transmitter. It takes approximately 2.5 second for the I/O port to change state and place the transmitter into the normal mode. The wake up duration is about 0.1 second.

This feature for initiating automatic shutdown represents a streamlined method for saving the stand-by power consumption of the transmitter. When the transmitter is in sleep mode initiated by an absence of motion, any trigger input from the MSA will charge the capacitor almost instantly to the Vdd level, waking up the microprocessor, and the transmitter will operate in the transmission mode, whether an automatic or motion-initiated mode, transmitting the RF data packet signal that occurred with the interrupt motion trigger.

If the transmitter is kept in continuous motion for a specified period, for more than ten minutes for example, the microprocessor will also go into the sleep mode and ignore the input trigger signal from the MSA. Approximately every 12 seconds, the microprocessor will check to see if pulse data is being received by the accelerometer, i.e., verify whether the transmitter is still in motion. If a non-movement trigger status is detected and confirmed, e.g., no motion trigger is present, the microprocessor will wake up from the sleep mode and revert to normal transmission mode, resetting the ignore function of the MSA so that subsequent motion will trigger transmission. Thereafter, if the transmitter is moved or has motion, it will transmit the RF signal in the normal motion-initiated transmit mode in which transmission is triggered by movement of the transmitter.

A more detailed summary of the function of the transmitter, including operation of the automatic shutdown module, is set forth in the flowchart of FIGS. 12A–12D. As shown therein, upon activation of the transmitter, a delay period for power stabilization is implemented, step 100, followed by testing steps 102, 103, which are used during manufacturing. Thereafter, the method determines whether the transmission detent pin has been depressed or "on" for over four seconds, step 104; an alternative period of time established to trigger response may, of course, be used. Requiring that the pin be "on" for at least a specified period prevents the reporting of anomalous motions as might be caused by a temporary vibration or other meaningless perturbation of the transmitter which depresses or switches the detent pin "on" before the transmitter has actually been attached to an object.

If the transmission detent pin has not been "on" for the specified period, then the microprocessor enters the sleep mode, step 106, during which current consumption is reduced to approximately 5$\mu$A. The microprocessor will thereafter remain asleep until the transmission detent pin has been "on" for the specified period, step 104.

If the transmission detent pin has been "on" for the specified period, step 104, this indicates that the transmitter has been attached to an object or individual. The transmission mode is initiated with normal operation, step 110, in which transmissions are triggered either at preset or random intervals, or in response to motion.

Upon entering the normal mode of operation, step 110, the transmitter verifies whether the emergency transmit pin is "off", step 112. If the emergency transmit pin is "off", this indicates that the transmitter has been removed from the device to which it was formerly affixed, and the transmitter enters an emergency mode of operation. In the emergency mode, an RF transmission emergency code is periodically and repeatedly transmitted, step 164, for a specified period, such as every ten seconds for one minute. The RF transmit counter is incremented and the status reported for each transmission, step 120. Thereafter the microprocessor reverts to sleep mode, step 106.

If the emergency transmit pin is not "off", step 112, then the transmitter determines whether an automatic transmit timer count has been detected, step 114, or whether a motion pulse has been detected, step 116. If the automatic transmit timer count has been detected indicating a preset or random interval has been reached and there is an absence of motion, step 114, then the automatic transmit timer count is reset, step 118, and a transmission is triggered, step 122. The RF counter is incremented and the status of the transmitter is reported with the transmission, step 120.

Figure 12A:
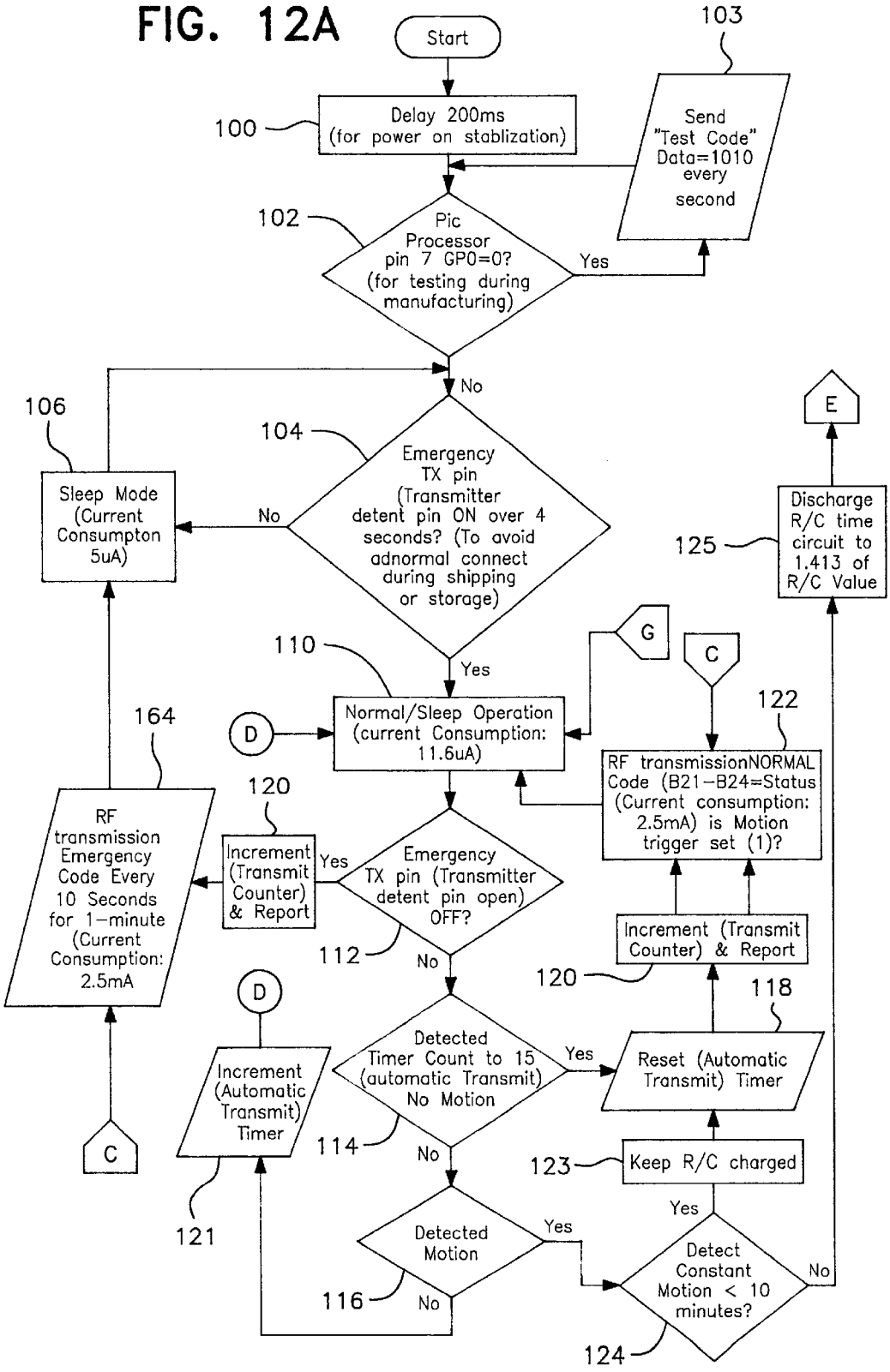
FIGS. 12A and 12B depict a flowchart illustrating the operation of the transmitter with automatic shutdown module of FIG. 11.

In the exemplary embodiment of FIG. 12A, the automatic transmit timer count is set to 15 minutes; alternatively, other durations of time may be used as needed or desired. Preferably, during the manufacturing process of the microprocessor chip, the nominal period for the automatic transmit timer is randomly set between 11 and 20 minutes. As a result, some transmitters are manufactured with an automatic transit timer set to 11 minutes, some to 13 minutes, some to 19 minutes, etc. This variation helps to fully randomize the transmit periods to avoid collisions.

In the embodiment shown in FIG. 12A, once the automatic transmit timer detects that there have been no transmissions during the nominal period set, e.g., 15 minutes, the microprocessor activates a random generator program that will issue a transmission at a random time thereafter. For example, in a preferred embodiment, the random generator program issues a transmission at a time that is between 0 and 54 seconds after the end of the nominal period (the 15 minutes).

In a preferred embodiment, the transmission may include a status bit indicating the type of transmission, with the motion trigger being set if the RF output was caused by an accelerometer activation. As an example, bit 21 (B21) may be set to "1" for motion or "0" for automatic, bit 23 (B23) may be set to "1" for emergency and "0" for no emergency, etc.

If a motion pulse has been detected, step 116, then the period of motion is determined. If the motion detected has a duration which is less than a specified period, ten minutes for example, step 124, then the automatic transmit timer count is reset, step 118, and a normal RF transmission is initiated, step 122, with the RF transmit counter being incremented and transmitter status reported, step 120. As shown, in response to non-continuous motion, step 124, the R/C circuit is kept charged, step 123, as a small amount of voltage is applied to the R/C circuit when the transmitter is not transmitting.

If motion has been detected and continues to be detected for a specified time duration, step 124, then a state of constant motion is determined. During times of transmission, there is no voltage applied to the R/C circuit and the capacitor starts to discharge, step 125. If there is a constant transmit then the capacitor is never allowed to charge and, under these conditions, it takes approximately 10 minutes to reach 30% (1.414) of the decay level of the capacitor. At this point the microprocessor, which monitors the I/O port every time a transmit cycle is performed, detects a logic change from "1" to "0", indicating that the transmitter is in constant motion. In response to this determination, the microprocessor reverts to sleep mode, step 126.

Figure 12B:
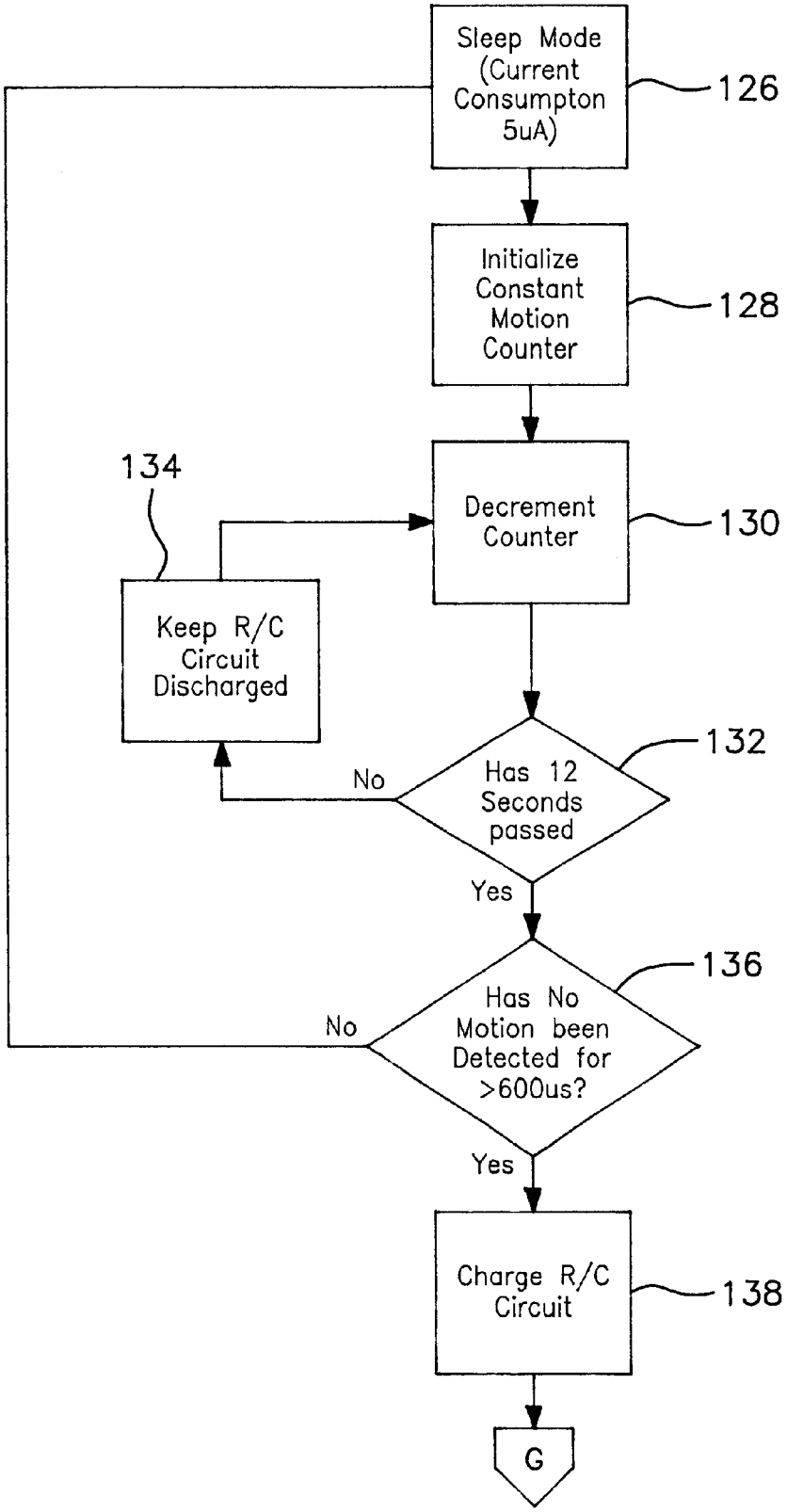

As shown in FIG. 12B, upon entry into sleep mode as initiated by constant motion, step 126, a constant motion counter is initialized, step 128, and then periodically decremented, step 130. If, at step 132, a specified period of time has not elapsed, such as 12 seconds for example, the discharged state of the R/C circuit is maintained, step 134. The counter is decremented until 12 seconds has passed, step 132, after which the microprocessor checks to see if pulse data is being received by the accelerometer. If there has not been an absence of motion lasting more than a specified period, for example 600 $\mu$s, step 136, the transmitter continues in sleep mode, step 126. If there has been an absence of motion for a specified period, such as 600 $\mu$s, then the voltage applied to the R/C circuit when the transmitter is not transmitting charges the capacitor, step 138, and the microprocessor resumes normal operation, step 110.

Figure 12C:
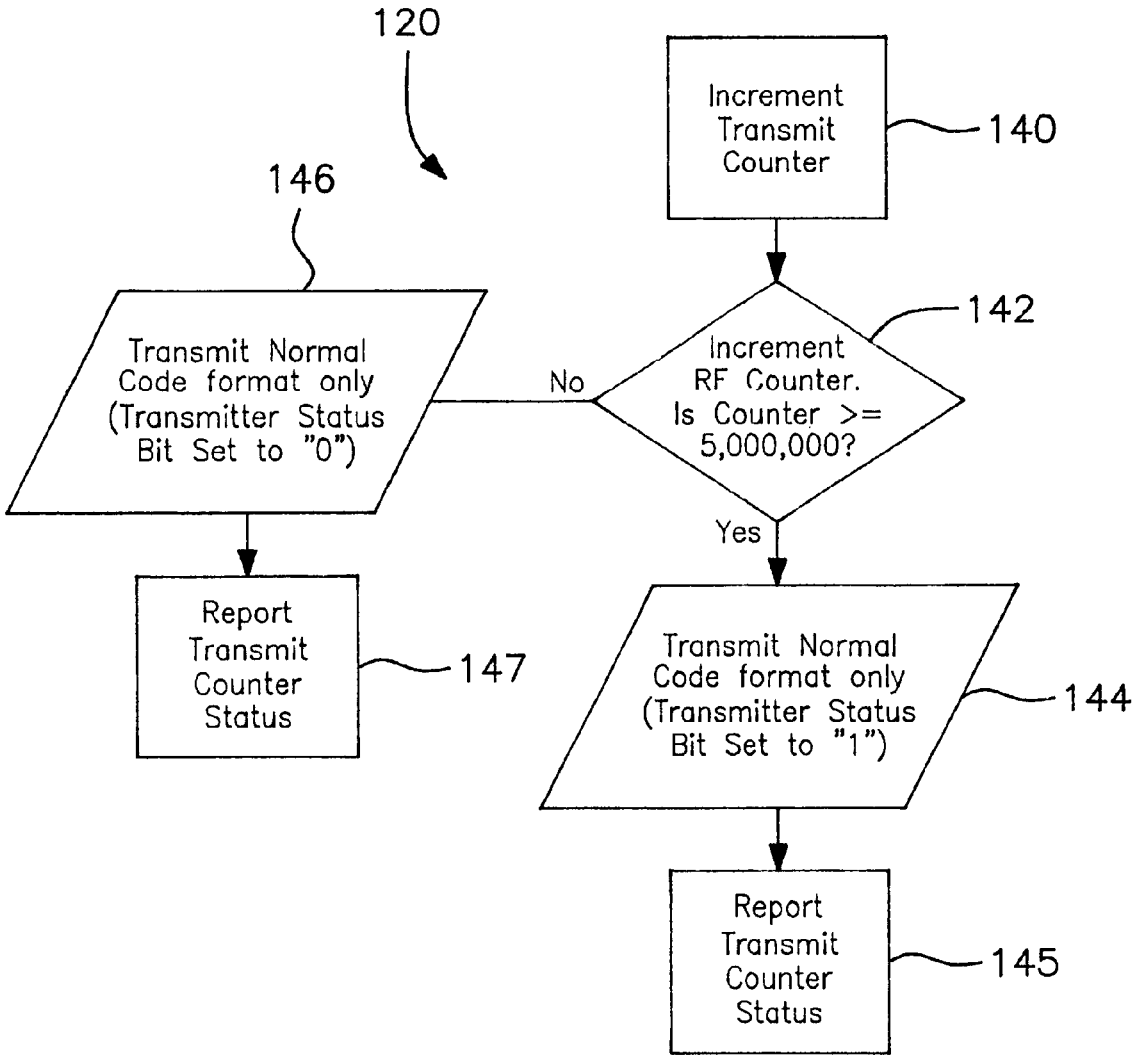
FIG. 12C is a flowchart of the function of the automatic RF transmit counter as shown in FIG. 12A.

The function of the automatic RF transmit counter, as represented by step 120 in FIG. 12A, is further explained in FIG. 12C. This feature preferably incorporates microprocessor firmware and typically takes the place of a hardware low-battery indicator.

As shown in FIG. 12C, each time the transmitter transmits a data package signal, the microprocessor increments the transmit counter, step 140, which may be a data register. The transmit counter is then compared with a threshold value, step 142. If the counter total is less than the specified value, then the transmitter status bit is set to "0", step 146, indicating that the transmitter does not yet need to be replaced, and the transmit counter status is reported, step 147. Once the transmit counter value exceeds the specified value indicating that the internal batteries are nearing exhaustion, the transmitter status bit is set to "1", step 144. The transmit counter status is then reported to the host system, step 145, informing the host that the transmitter, based on the history of transmits, must be replaced within a given period of time, for example 30 days. The given period will reflect a determination made based on actual usage of that transmitter.

In a preferred embodiment, the transmitters are hermetically sealed such that the batteries cannot be replaced separately from the transmitter itself. However, the present invention could, of course, be implemented with transmitters having batteries that may be removed and replaced while keeping the original transmitter.

The RF transmit counter of the present invention eliminates the need to incorporate costly hardware within the transmitter unit in order to monitor the status of the battery. Unlike hardware battery detection circuits, the present technique is internal to the transmitter circuitry, allowing the transmitter package to be made smaller and at the same time reducing current drain on the internal battery cells.

The automatic peripheral data (APD) interface includes microprocessor firmware and electronic hardware incorporating an R/C data filter and voltage divider network connected to the microprocessor I/O port. The combined elements provide a gateway between the transmitter and the external device to which it is affixed. Providing such a gateway between external equipment and the transmitter enables different aspects of the status of the external device to be monitored. The driving force is the ability to convert device logic digital data ("1" and "0") to form a static output to a dynamic interface at the transmitter. This information provided to the transmitter is then encoded and becomes a portion of the data packet being transmitted to the transceiver and then to the host unit.

The information provided through the APD interface makes it possible to know not only the actual location of the device within a structured area or facility, but also the status of the device. For example, if the transmitters are being used to track medical equipment in a care facility, with the APD interface it is possible to track both the location of a specific piece of equipment and whether or not the piece of equipment is turned on or off, or whether the equipment has failed and has generated an error message. Similarly, if the transmitter is affixed to a vehicle, the APD interface enables a maintenance status request to be transmitted to the host unit simultaneously with the positional data. As a further example, if the transmitter is attached to a piece of equipment that uses a temperature sensor, the status of the temperature sensor can be incorporated into the packet data transmission. These are just some examples of the capability provided by the APD interface.

Figure 12D:
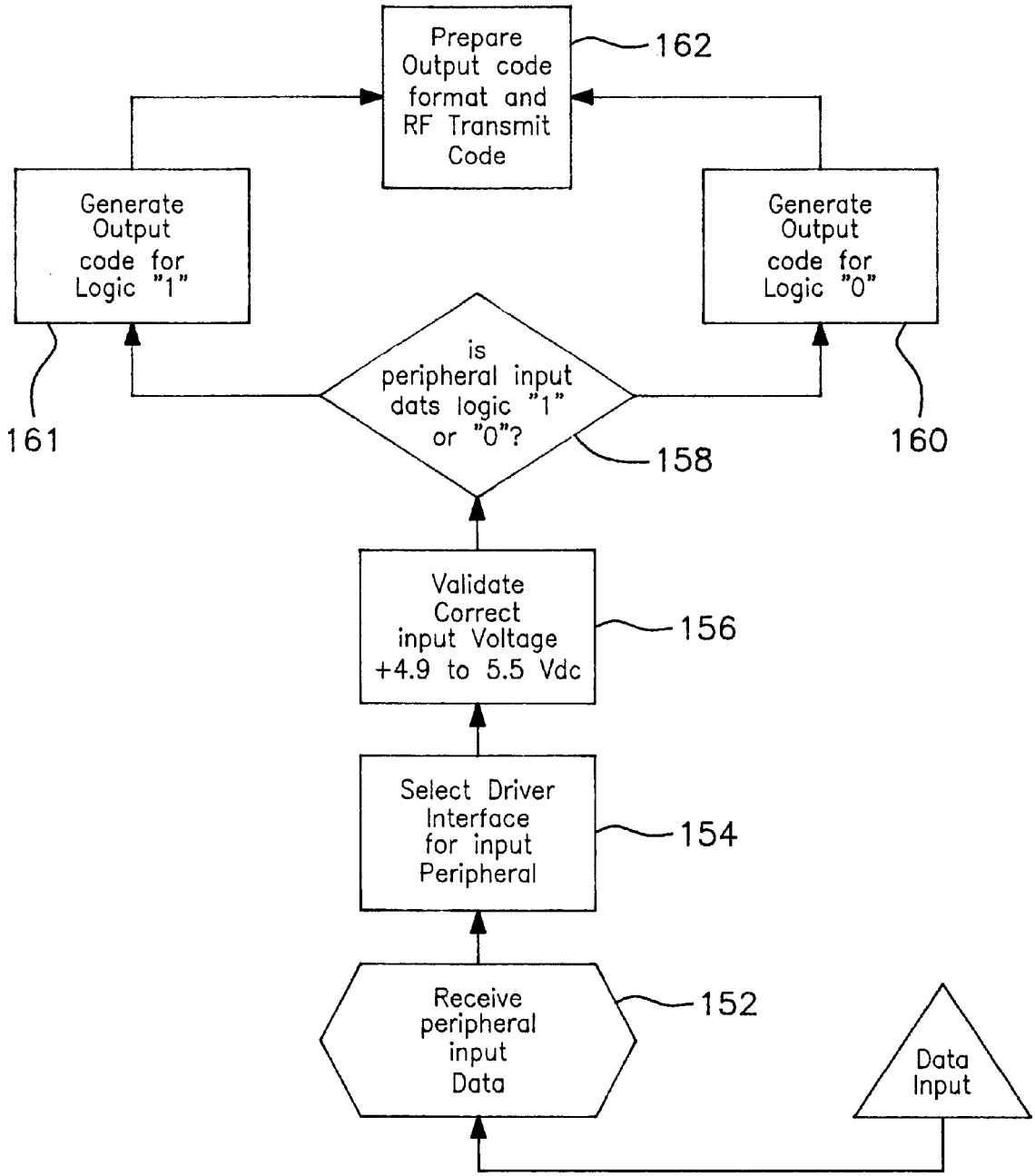
FIG. 12D is a flowchart of the function of the automatic peripheral data interface with the process of FIG. 12A for use in the locating, positioning and monitoring asset tracking system of the present invention.

The function of the APD interface is summarized in FIG. 12D. Following data input to the peripheral device, step 150, the transmitter receives the peripheral input data, step 152, and selects a driver interface for the input peripheral, step 154. The correct input voltage is validated, step 156, and the peripheral input data logic is determined to be logic "1" or logic "0", step 158. An output code for logic "1", step 161, or logic "0", step 160, is generated, as appropriate, after which the output code format and RF transmit code is prepared, step 162. The peripheral input data is then transmitted with the normal RF transmission 122.

The peripheral input data enables the host unit to not only track particular status information pertaining to the device, but this information may be used in a number of ways to control or trigger the operation of other systems. For example, the locating, positioning and monitoring system of the present invention may be used by a security company to track devices in a warehouse belonging to a third party owner. The owner of the devices being tracked may specify that if an output code of logic "1" is received for a peripheral device, this indicates that the device has been activated. If, in response to receiving a transmission indicating the activation of a device, the security company has been instructed to, for example, turn on the building lights in which the device resides, the monitoring function provided by the present invention is clearly instrumental in ways that go beyond simply detecting the location of a given transmitter.

The enhancements to the real-time asset tracking system are fully integrated with the data base and mapping software used to continuously display and update the positions of each of the transmitters on a digitized image of the floor plan of the facility within which the transmitters and their associated objects are housed. The floor plan may be depicted in three dimensions to indicate stacking or other physical relationships between objects being tracked. The location, position and status of any particular object associated with a transmitter are displayed on the central processing unit monitor on an ongoing and real-time basis. Transmitter status as tracked by the transmit counter may also be displayed in a visual manner. For example, in response to receiving a transmitter status bit set to "1", the on-screen display showing the location of that transmitter may be set to flash, pulse, fade, change color, etc., indicating the need for transmitter and/or battery replacement.

Displayed status information may further include information received from the automatic peripheral data interface. For example, the display screen may be set up to display whether the object being tracked is on or off by displaying a particular color, intensity, or any other visual indicator, in association with the transmitter location indicator as shown on the floor plan. As the object or asset is moved through the facility, its motion, status information and current position relative to the floor plan is automatically displayed along with the time and date of movement.

The present invention may be embodied in other specific forms without departing from the spirit or essential attributes thereof, and it is therefore desired that the present embodiment be considered in all respects as illustrative and not restrictive. Rather, all suitable modifications and equivalents may be resorted to, falling within the scope of the invention.

What is claimed is:

1. A system for locating, positioning and monitoring an object, either inanimate or animate, in a facility, the system comprising:

a transmitter member attached to the object, said transmitter member having a power source, a discrete preset encryption code, a radio frequency transmitter circuit for transmitting a preset radio frequency as a transmitter signal for a preset distance, and a process timer for selectively programming a frequency interval for transmitting said transmitter signal;

at least one transceiver member positioned within range of said transmitter member, said transceiver member comprising a radio frequency receiver circuit for receipt of said transmitter signal, an interface circuitry in communication with said receiver circuit, and a microprocessor, said interface circuitry and said microprocessor validating said incoming transmitter signal using an embedded algorithm, said transceiver member further including a data storage element for storing incoming data, an input/output circuit for retransmitting said data, and a power supply;

a host central processing unit in communication with said transceiver member for receiving said data, said host central processing unit having, a display unit displaying, on a continuous basis, a digital floor plan of the facility, said digital floor plan outlining physical locations of all transceiver members installed in the facility and, for each transceiver, an associated area for receipt of incoming transmitter data;

data base software capability for identifying said object; and mapping software capability for monitoring and displaying, on a continuous basis, said digital floor plan of the facility with a location of said object thereon such that, as the object is moved through the facility, its motion is automatically displayed relative to said facility floor plan.

2. The system in accordance with claim 1, wherein the automatic display of the object's movement through the facility includes display of a status, time and date of movement of the object.

3. The system in accordance with claim 1, wherein the digital floor plan being displayed further includes a location, position and status of any particular object associated with any transmitter member within said facility.

4. The system in accordance with claim 1 wherein there is only one transceiver member.

5. The system in accordance with claim 1 wherein there are a plurality of transceiver members, each of said transceiver members communicating directly and independently with said host central processing unit such that there is no transceiver to transceiver communication.

6. The system in accordance with claim 1 wherein said process timer places said transmitter member in a no power mode when not broadcasting, thereby conserving the power source.

7. The system in accordance with claim 1 wherein said transmitter member is incorporated into one of a wrist band, name tag, or belt attachment for use with animate objects.

8. A system for locating, positioning and monitoring an object, either inanimate or animate, the system comprising:

a plurality of multi-directional, long range transmitter members, each of said plurality of multi-directional transmitter members attached to a discrete object to be monitored, each of said transmitter members having, a power source;

a discrete, programmable, preset encryption code;

an input/output microprocessor controller with security function enabling encryption code change;

a radio frequency transmitter circuit for transmitting a preset radio frequency for a preset distance; and a microprocessor controller for selectively programming the frequency interval for transmitting said preset radio frequency;

a plurality of transceiver members, at least one of said plurality of transceiver members positioned within range distance of at least one of said plurality of transmitter-members, said transceiver members positioned within range distance of said multi-directional transmitter members simultaneously receiving said preset radio frequency signal from said multi-directional transmitter members within said range distance, each of said transceiver members including, a radio frequency receiver circuit for receipt of said preset radio frequency;

an interface circuitry in communication with said receiver circuit;

a microprocessor, said interface circuitry and said microprocessor validating incoming data on said preset radio frequency and signal strength by means of an embedded algorithm;

a data storage element for storing said incoming data;

an input/output circuit for retransmitting said data; and a power supply;

a host central processing unit in direct communication with each of said plurality of transceiver members for receipt of said data directly from each transceiver member, said host central processing unit having, a display unit displaying, on a continuous basis, a digital floor plan of the facility, said digital floor plan outlining physical locations of all transceiver members installed in the facility and, for each transceiver, an associated area for receipt of incoming transmitter data;

data base software capability for identifying said object; and mapping software capability for monitoring and displaying, on a continuous basis, said digital floor plan of the facility with a location of said object thereon such that, as the object is moved through the facility, its motion is automatically displayed relative to said facility floor plan.

9. The system in accordance with claim 8, wherein the automatic display of the object's movement through the facility includes display of a status, time and date of movement of the object.

10. The system in accordance with claim 8, wherein the digital floor plan being displayed further includes a location, position and status of any particular object associated with any transmitter member within said facility.

11. The system in accordance with claim 8 wherein there are a plurality of transceiver members, each of said transceiver members communicating directly and independently with said host central processing unit such that there is no transceiver to transceiver communication.

12. The system in accordance with claim 8 wherein said plurality of transceivers can request multiple validations from said transmitter member to validate said signal.

13. The system in accordance with claim 8 wherein at least one transceiver converts said preset radio frequency from at least one transmitter member to ASCII code for storage and retransmission.

14. The system in accordance with claim 8 wherein said host central processing unit utilizes said data base software capability to maintain inventory and processing control.

15. The system in accordance with claim 8 wherein said host central processing unit utilizes said mapping software capability in identifying the location of said object having said transmitter member attached thereto by means of multiple reception signals received by said plurality of transceiver members, said mapping software capability providing said display in real time.

16. A system for locating, positioning and monitoring an object, either inanimate or animate, in a facility, the system comprising:

a transmitter member attached to the object, said transmitter member having, a power source;

a discrete preset encryption code;

a radio frequency transmitter circuit for transmitting a preset radio frequency as a transmitter signal for a preset distance;

a microprocessor controller for controlling transmissions at said preset radio frequency, said microprocessor having a transmission mode and a sleep mode;

an automatic RF transmit counter, each transmission by said transmitter member incrementing a count total of a data register by one, said counter comparing said count total with a threshold value and setting a transmitter status bit to indicate a result of said comparison; and an automatic shutdown module for initiating said sleep mode for conservation of said power source in response to a motion status of said transmitter member;

at least one transceiver member positioned within range of said radio frequency transmitter member, said transceiver member comprising a radio frequency receiver circuit for receipt of said transmitter signal, an interface circuitry in communication with said receiver circuit, and a microprocessor, said interface circuitry and said microprocessor validating said transmitter signal using an embedded algorithm, said transceiver member further including a data storage element for storing incoming data, an input/output circuit for retransmitting said data, and a power supply; and a host central processing unit in communication with said transceiver member for receiving said data and said transmitter status bit, said host central processing unit having data base software capability, mapping software capability, and a display unit for depicting a digitized floor plan of the facility, said data base software capability identifying said object and said mapping software capability monitoring and displaying a location of said object on said digital floor plan of the facility on a continuous basis.

17. The system in accordance with claim 16, wherein said automatic shutdown module includes a motion sensor accelerometer for detecting the motion status of said transmitter member, said automatic shutdown module initiating said sleep mode in response to output from said motion sensor accelerometer indicating substantially continuous motion of said transmitter member for a specified time period.

18. The system in accordance with claim 17, wherein said specified time period is approximately ten minutes.

19. The system in accordance with claim 16, wherein said automatic shutdown module includes a motion sensor accelerometer for detecting the motion status of said transmitter member, said automatic shutdown module initiating said sleep mode in response to output from said motion sensor accelerometer indicating an absence of motion of said transmitter member for a specified time period.

20. The system in accordance with claim 19, wherein said specified time period is approximately four seconds.

21. The system in accordance with claim 16, wherein said power source is a battery and said transmitter status bit indicates an expected remaining lifespan of said battery.

22. The system in accordance with claim 16, said transmitter member further comprising:

an automatic peripheral data interface for receiving status information from said object, said transmitter member transmitting said status information to said transceiver member as part of said transmitter signal for retransmission to said host central processing unit.

* * * * *